US011503417B2

(12) United States Patent
Baker et al.

(10) Patent No.: US 11,503,417 B2
(45) Date of Patent: Nov. 15, 2022

(54) IN-EAR RADIO FREQUENCY ANTENNA

(71) Applicant: DOLBY LABORATORIES LICENSING CORPORATION, San Francisco, CA (US)

(72) Inventors: Jeffrey Ross Baker, Thousand Oaks, CA (US); Ian Eric Esten, San Francisco, CA (US); Shaohon Chen, Pleasanton, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 17/255,417

(22) PCT Filed: Jun. 24, 2019

(86) PCT No.: PCT/US2019/038701

§ 371 (c)(1),
(2) Date: Dec. 22, 2020

(87) PCT Pub. No.: WO2020/005818

PCT Pub. Date: Jan. 2, 2020

(65) Prior Publication Data

US 2021/0352419 A1 Nov. 11, 2021

Related U.S. Application Data

(60) Provisional application No. 62/837,612, filed on Apr. 23, 2019, provisional application No. 62/690,225, filed on Jun. 26, 2018.

(51) Int. Cl.
*H04R 25/00* (2006.01)
*H01Q 1/27* (2006.01)
(Continued)

(52) U.S. Cl.
CPC ..... *H04R 25/554* (2013.01); *H01Q 1/273* (2013.01); *H01Q 7/00* (2013.01); *H04R 1/1016* (2013.01);
(Continued)

(58) Field of Classification Search
CPC .. H04R 25/554; H04R 1/1016; H04R 25/652; H04R 2225/51; H04R 2225/61; H04R 2201/10; H01Q 1/273; H01Q 7/00
See application file for complete search history.

(56) References Cited

U.S. PATENT DOCUMENTS 5,721,783 A 2/1998 Anderson
7,068,803 B2 * 6/2006 Kuhlmann ..... A61F 11/00 381/328
(Continued)

FOREIGN PATENT DOCUMENTS

CN 101364667 A 2/2009
CN 201191919 2/2009
(Continued)

*Primary Examiner* — Brian Ensey

(57) ABSTRACT

An apparatus may include a housing adapted for at least partial insertion into a concha bowl of a human ear, at least one speaker residing in or on the housing, a control system residing in or on the housing and a positioning element attached to the housing. The control system may be configured for controlling the speaker and configured for radio frequency (RF) communication. The positioning element may be configured to fit at least partially inside a concha of the human ear and may be configured to retain the housing at least partially within the concha bowl. The positioning element may include one or more wires Control System configured for communication with the control system. The one or more wires may be configured for at receiving and/or transmitting RF radiation. In some examples, the positioning element may be, or may include, a concha lock. The positioning element may include a loop antenna.

17 Claims, 6 Drawing Sheets

(51) Int. Cl.
*H01Q 7/00* (2006.01)
*H04R 1/10* (2006.01)

(52) U.S. Cl.
CPC ..... *H04R 25/652* (2013.01); *H04R 2225/51* (2013.01); *H04R 2225/61* (2013.01)

(56) References Cited

U.S. PATENT DOCUMENTS

| | | | | |
|---|---|---|---|---|
| 10,051,388 | B2 * | 8/2018 | Polinske | H04R 25/602 |
| 2004/0096075 | A1 | 5/2004 | Kuhlmann | |
| 2009/0123010 | A1 | 5/2009 | Cano | |
| 2009/0214064 | A1 | 8/2009 | Wu | |
| 2010/0020994 | A1 * | 1/2010 | Christensen | H04R 25/554 381/315 |
| 2013/0123919 | A1 | 5/2013 | Goldstein | |
| 2013/0343586 | A1 | 12/2013 | Kvist | |
| 2017/0013375 | A1 * | 1/2017 | Henriksen | H04R 25/65 |
| 2018/0070165 | A1 * | 3/2018 | Hatfield | H04R 1/1058 |
| 2018/0084351 | A1 | 3/2018 | Polinske | |

FOREIGN PATENT DOCUMENTS

| | | | | |
|---|---|---|---|---|
| CN | 109429160 A | * | 3/2019 | H01Q 1/273 |
| WO | 2014179613 | | 11/2014 | |

* cited by examiner

FIGURE 5A
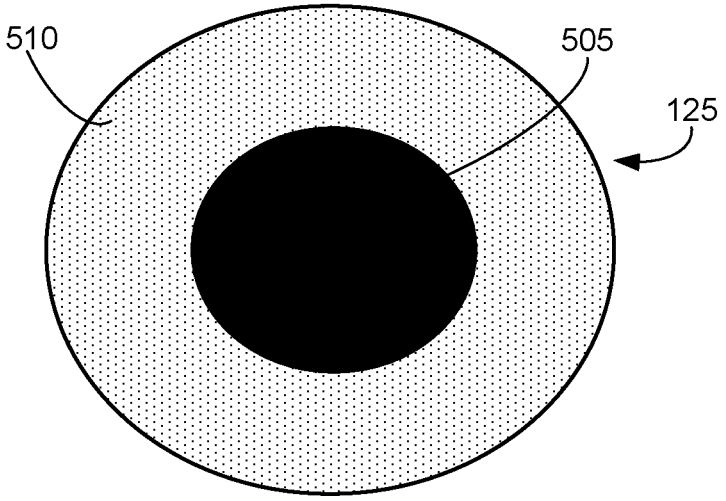
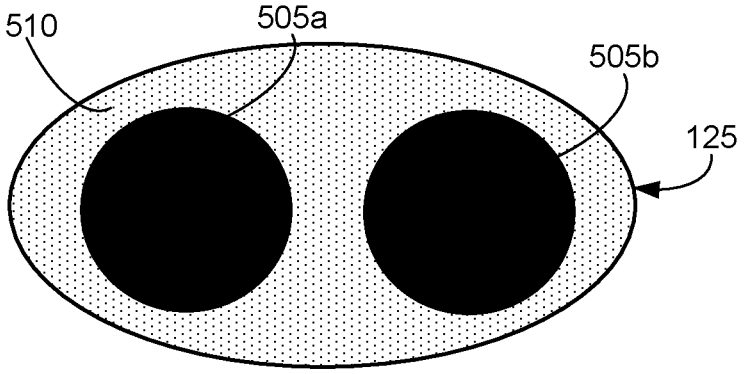
FIGURE 5B

IN-EAR RADIO FREQUENCY ANTENNA

TECHNICAL FIELD

This disclosure relates to audio devices worn in the ear.

BACKGROUND

RF (radio frequency) communication with devices worn in the ear, such as ear buds or hearing enhancement devices, can be challenging because of RF absorption by the body. Because the human body is largely electrically conductive, it can absorb RF radiation. The situation is especially challenging with ear devices that fit completely or substantially into the ear canal, because such ear devices are surrounded on all but an outward facing face by flesh.

SUMMARY

At least some aspects of the present disclosure may be implemented via apparatus. For example, one or more devices may be capable of performing, at least in part, the methods disclosed herein. In some implementations, an apparatus may include a housing adapted for at least partial insertion into an ear canal or a concha bowl of a human ear, at least one speaker residing in or on the housing, a control system residing in or on the housing and a positioning element attached to the housing. In some such implementations, the control system may be configured for controlling the speaker and configured for radio frequency (RF) communication.

The positioning element may include one or more wires configured for communication with the control system. The one or more wires may be configured for at receiving and/or transmitting RF radiation. The positioning element may be configured to fit at least partially inside a concha of the human ear and may be configured to retain the housing at least partially within the concha bowl. In some examples, the positioning element may be, or may include, a concha lock. In some implementations, the positioning element may be, or may include, a post having an antenna in a post tip. According to some examples, the positioning element may include a loop antenna.

Some such implementations may have potential advantages. Because flesh contains water, it has a relatively high electrical permittivity and is substantially electrically conductive. These properties of the head and skin can dramatically affect the electric fields of electromagnetic waves, absorbing RF energy that would have otherwise been available for transmission or reception. With a positioning element such as a concha lock antenna or a post tip antenna this attenuation can be at least somewhat reduced, because at least a portion of the positioning element can be designed to extend at least a few millimeters away from the ear. In some examples, a positioning element such as a concha lock can be electrically connected as a loop antenna. Loop antennae, in contrast to monopole or dipole antennae, have near-field radiation patterns that are dominated by magnetic rather than electric components of the electromagnetic field. Loop antennae are therefore less affected by the proximity of the high-permittivity and high conductivity skin and head.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

FIGS. 5A and 5B show cross-sections through two examples of positioning elements.

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular applications and environments, the teachings herein are widely applicable to other known applications and environments. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

As noted above, RF communication with devices worn in the ear, such as ear buds or hearing enhancement devices (which may be referred to herein as "in-ear devices"), can be challenging because of RF absorption by the body. Various disclosed implementations provide improved RF (radio frequency) antennae for in-ear devices.

Figure 1:
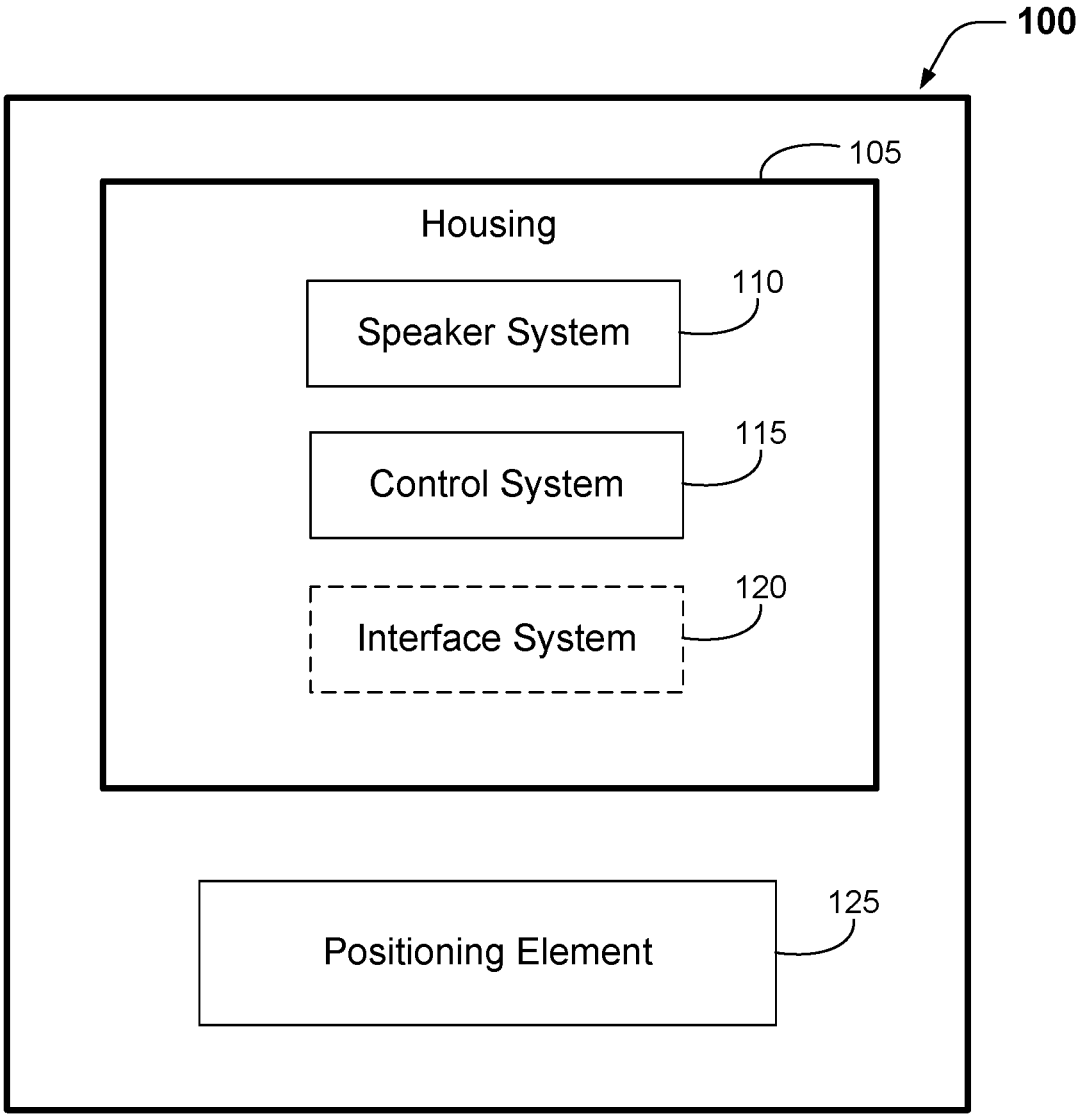
FIG. 1 is a block diagram that shows examples of components of an apparatus that may be configured to perform at least some of the methods disclosed herein.

FIG. 1 is a block diagram that shows examples of components of an apparatus that may be configured to perform at least some of the methods disclosed herein. In this example, the apparatus 100 is, or includes, an in-ear device. In some such examples, the apparatus 100 may be, or may include, a hearing aid, an ear bud or another type of in-ear device. The types and numbers of components shown in FIG. 1, as well as other figures disclosed herein, are merely shown by way of example. Alternative implementations may include more, fewer and/or different components.

In this example, the apparatus 100 includes a housing 105. In some implementations, the housing 105 may be adapted for at least partial insertion into a concha bowl of a human ear. According to some examples, the housing 105 may include a polymer, such as a plastic and/or an elastomer.

According to this implementation the speaker system 110 includes at least one speaker residing in or on the housing 105. The type of speaker(s) included in the speaker system 110 may vary according to the particular implementation, e.g., depending on the intended use of the apparatus 100. For example, the characteristics of the speaker(s) included in the speaker system 110 may vary according to whether the apparatus is a hearing aid, an ear bud or another type of in-ear device. In some implementations, the apparatus 100 may include one or more microphones and related circuitry.

In this example, the apparatus 100 includes a control system 115 residing in or on the housing. The control system 115 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the control system 115 is configured for controlling the speaker and is configured for radio frequency (RF) communication. Accordingly, the control system 115 may include RF circuitry, such as a Bluetooth® radio, a Bluetooth® Low Energy radio, a Wi-Fi radio, a near-field magnetic induction radio, and/or one or more other types of radio transmitters, receivers or transceivers. The radio(s) may reside within a multi-purpose processor or in a processor that is dedicated to RF communication, depending on the particular implementation. In some examples, the control system 115 may be configured to provide audio processing such as noise cancellation, hearing augmentation, audio data decoding, etc.

According to this example, the apparatus 100 includes a positioning element 125. Various examples of the positioning element 125 are disclosed herein. In some instances, the positioning element 125 may be configured to fit at least partially inside a concha of a human ear. In some examples, the positioning element 125 may be configured to retain the housing at least partially within the concha bowl. According to some such examples, the positioning element 125 may be, or may include, a concha lock.

In some implementations, the positioning element 125 may include one or more wires that are configured for communication with the control system. According to some examples, the one or more wires may be further configured for receiving and/or transmitting radio frequency radiation. According to some examples, the positioning element may include a loop antenna. The one or more wires may be one or more components of the loop antenna.

Although the interface system 120 is shown as an optional element of the housing 105 in FIG. 1, the interface system 120 may include one or more antennas of a wireless interface. For example, the wireless interface may include the one or more wires of the positioning element 125 that are configured for receiving and/or transmitting radio frequency radiation. Accordingly, the interface system 120 may include one or more electrical connections between the one or more wires of the positioning element 125 and the control system 115. In some examples, the interface system 120 may include one or more interfaces between the control system 115 and a memory system (not shown in FIG. 1).

In some implementations, the interface system 120 may include a user interface system. The user interface system may be configured for receiving input from a user. In some implementations, the user interface system may be configured for providing feedback to a user. For example, the user interface system may include one or more touch and/or gesture detection sensor systems, one or more inertial sensor devices, etc. According to some examples, the user interface system may include apparatus for providing haptic feedback, such as a motor, a vibrator, etc.

In some examples, the apparatus 100 may be implemented in a single device. However, in some implementations, the apparatus 100 may be implemented in more than one device, e.g., via a pair of in-ear devices. In some such implementations, functionality of the control system 115 may be included in more than one device. In some examples, the apparatus 100 may be a component of another device.

In some implementations, the positioning element 125 may be, or may include, a post attached to the housing 105. In some such implementations, the positioning element 125 may be, or may include, a tip configured for transmitting and/or receiving radio frequency radiation and one or more wires configured for communication between the tip and the control system. According to some examples, the positioning element may include a chip antenna or a loop antenna. In some implementations, the tip may be configured to protrude from an intertragal notch of a human ear when the housing has been at partially inserted into a concha bowl of the human ear.

In some examples, the post may be, or may include, a loop. The loop may include a loop antenna. Such posts may or may not have a tip, depending on the particular implementation.

In some implementations the post may include flexible material, such as a flexible polymer (e.g., nylon). However in alternative implementations the post may include relatively more rigid material. The post may include a bulb on the end to improve graspability and/or to serve as an antenna portion.

In some examples, an insulating strain-relieving sheath may be disposed around the wires of the positioning element 125, to mechanically protect the post when pulled or bent. According to some such examples, the sheath may be strain-relieved to the housing 105 of an in-ear device, such that forces on the sheath are transmitted to the housing 105 of the ear device rather than to the wires or electrical connection of the wires to an RF circuit (e.g., of the control system 115).

Figure 2:
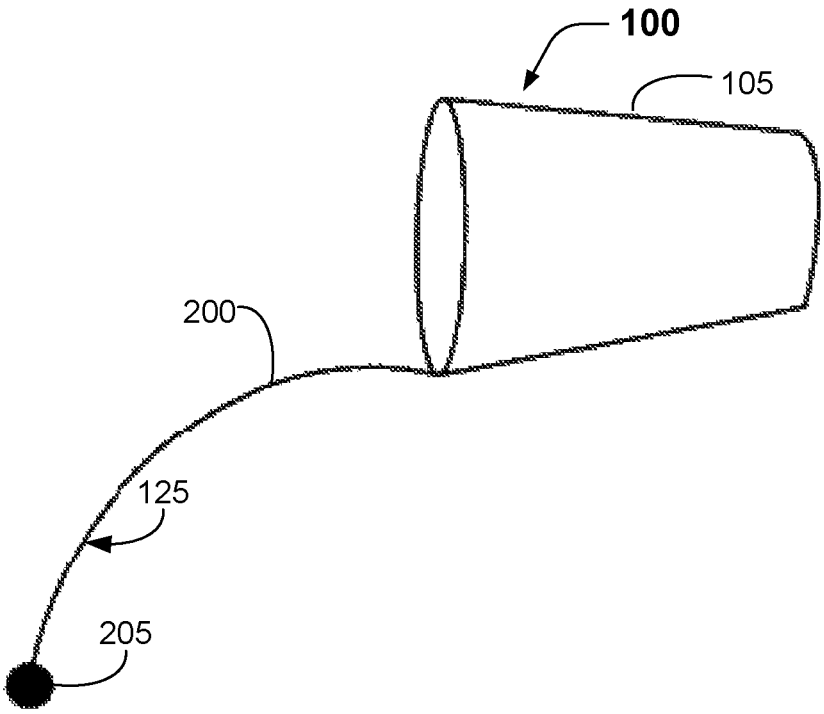
FIG. 2 shows an example of an in-ear device.

FIG. 2 shows an example of an in-ear device. In this example, the apparatus 100 includes a positioning element 125 attached to a housing 105. According to this example, the positioning element 125 is a post that includes a post tip 205 that is configured to radiate and/or receive RF radiation. The post tip 205 may include a chip antenna, a loop, or other configuration, depending on the particular implementation. The tip antenna may be disposed within the post tip 205, and may in some examples be encased (e.g., in a polymer or resin) to form a small bulb at the tip of the post, e.g., as shown in FIG. 2.

In this example, the positioning element 125 includes a wired portion 200 that contains one or more wires. According to some implementations, the one or more wires are configured for conduction of RF energy to and or from the post tip 205. In some such embodiments the one or more wires inside the wired portion 200 may include a central wire and a coaxial shield, as in a typical coaxial cable. In some instances, the one or more wires inside the wired portion 200 may be, or may include, two parallel or substantially parallel traces. In some examples, the one or more wires may include an impedance-matched conductor and ground.

In some examples, the wires within the wired portion 200 may be formed with a flexible printed circuit (FPC). The FPC may contain components, such as resistors, inductors, or capacitors. The FPC may include traces in in various shapes, depending on the particular implementation.

According to some implementations, the positioning element 125 may be transparent, substantially transparent, or translucent. In some such implementations, the one or more wires may be formed of transparent materials, such as Indium Tin Oxide (ITO), silver nanowire filled silicon or plastic, etc. In some such examples, the sheath may be formed of transparent plastic or polymer.

The cross section of the positioning element 125 may or may not be circular, depending on the particular implementation and depending, in some instances, along which plane the cross-section is taken. Some examples are described below with reference to FIGS. 5A and 5B. In some examples at least a portion of the positioning element 125 may be relatively flat, such as a strip antenna.

Figure 3:
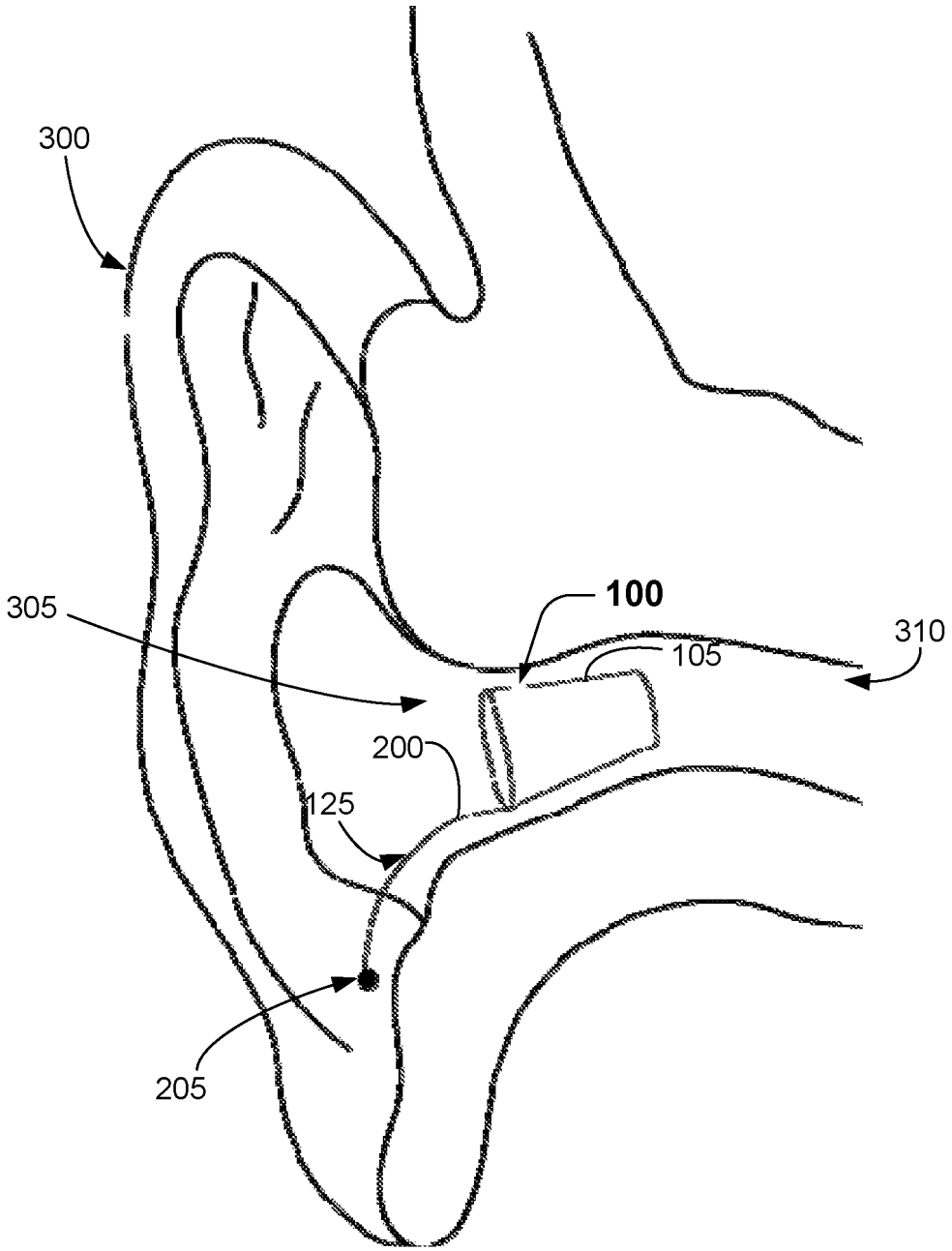
FIG. 3 shows an example of the in-ear device of FIG. 2 at least partially disposed within a human ear.

FIG. 3 shows an example of the in-ear device of FIG. 2 at least partially disposed within a human ear. In this example, the housing 105 is disposed within a concha bowl 305 and within an ear canal 310 of the human ear 300. According to this example, the positioning element 125 is configured so that the post tip 205 protrudes from the ear 300 when the housing 105 is positioned in the ear 300. The post tip 205 is configured to radiate and/or receive RF radiation. Such configurations are potentially advantageous because they are subject to relatively less RF absorption caused by the ear 300 and other parts of the human body, as compared to in-ear devices that include antennas within the ear canal.

In the implementations shown in FIGS. 2 and 3, the positioning element 125 is attached to the housing 105 at or near a periphery of the housing 105. In some such implementations, the position in which the positioning element 125 is attached to the housing 105 may indicate an orientation of the apparatus 100 and may indicate a desired placement of the post relative to the ear.

For example, users may be informed that the in-ear device should be oriented with the post at the bottom. In some such implementations, the post tip 205 may protrude from the intertragal notch, to better transmit RF away from the body.

According to some examples, the post may be sufficiently stiff such that the post does not sag. The post may be configured to protrude into the concha cavum. In some examples, the post may be configured to be suspended in air, as far away from all ear parts as practicable. In some such examples, the post may be configured to extend perpendicularly or at an angle from the outer face of the housing 105.

In some examples, the post length may be such that the post tip 205 protrudes beyond the ear, as a way to better emit RF away from the body and also as a way to gauge correct ear device insertion depth. Users could be instructed, for example, to "insert the ear device until the tip protrudes just outside the integral notch."

According to some implementations the tip may be jeweled, as a form of jewelry, for example with gold, a pearl, or a gemstone. Such decoration may reduce the stigma of wearing the ear device, and also provide an opportunity to add more electrically-conductive material at the tip.

A concha lock can help retain a device such as the apparatus 100 in the ear during vigorous activity and can maintain user confidence that in-ear devices will not fall out.

Figure 4A:
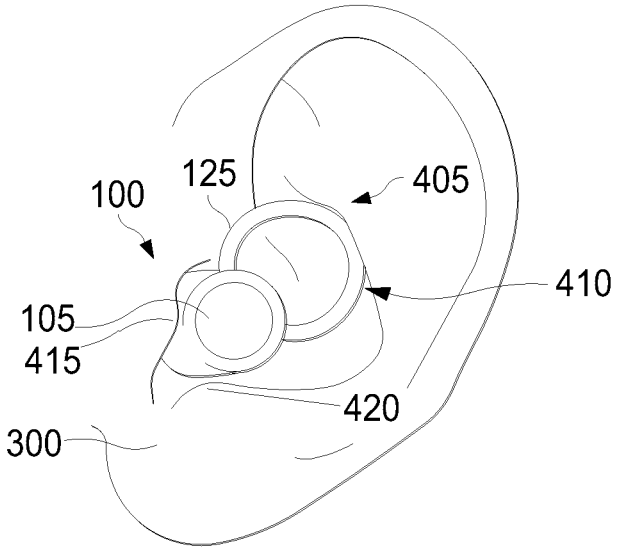
FIG. 4A shows an example of an in-ear device that includes a concha lock.

FIG. 4A shows an example of an in-ear device that includes a concha lock. In this example, the positioning element 125 includes the concha lock. Although in this example the concha lock is circular, or substantially circular, in other implementations the concha lock may have other shapes. Some examples are provided herein. For example, in other implementations the concha lock may have an oval shape, a comma shape, a "shark fin" shape, a cycloidal shape, etc.

Here, the positioning element 125 extends from the housing 105 of the apparatus 100 and is configured to fit at least partially inside the concha bowl of the human ear 300. (The terms "concha bowl" and "concha" may be used synonymously herein.) In this example, the positioning element 125 is further configured to retain the housing 105 at least partially within the concha bowl.

In the example shown in FIG. 4A, the concha lock is configured to reach the rear edge of the concha, so as to provide gentle pressure to improve retention of the housing 105 within the ear 300. According to this example, the concha lock is configured to provide additional inward retention by hooking under the antihelix 405 at the rear and/or upper edge of the concha, and by causing features of the housing 105 to interface more firmly in the bottom and front edges of the concha behind the tragus 415 and above the antitragus 420. In this example, the concha lock is configured to extend inside the cymba concha 410, behind the uppermost fold of the antihelix 405.

Figure 4B:
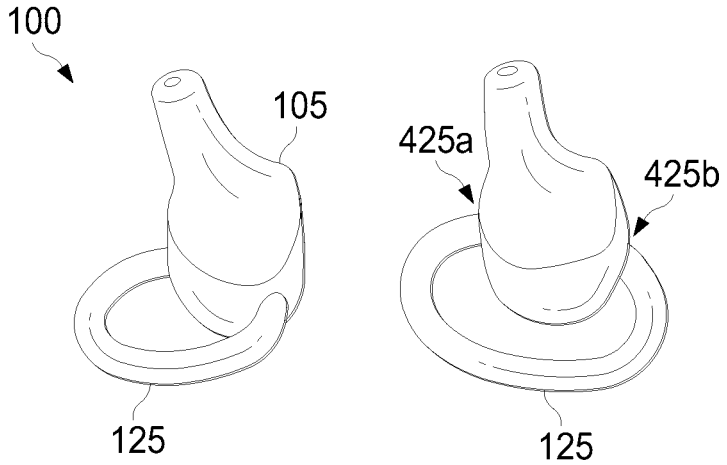
FIG. 4B shows two instances of the apparatus of FIG. 4A outside of a human ear.

FIG. 4B shows two instances of the apparatus of FIG. 4A outside of a human ear. FIG. 4B provides more complete views of the housing 105, including portions that are positioned inside the ear 300 in FIG. 4A. Moreover, FIG. 4B clearer views of the housing locations 425*a* and 425*b* at which the positioning element 125 is attached to the housing 105.

In these implementations, the positioning element 125 includes one or more wires that are configured for communication with a control system (not shown) of the apparatus 100. In this example, the one or more wires are further configured for receiving and/or transmitting radio frequency radiation. According to these implementations, the one or more wires of the positioning element 125 form a loop antenna.

A concha lock is a potentially advantageous element in which to build an antenna for several reasons. Whether round, comma-shaped, or any other shape, a concha lock that forms a loop (e.g., by being connected to the housing 105 at two locations) can electrically be connected as a loop antenna. Loop antennae, in contrast to monopole or dipole antennae, have near-field radiation patterns that are dominated by magnetic rather than electric components of the electromagnetic field. Loop antennae are therefore less affected by the proximity of the high-permittivity and high-conductivity skin of the ear and head.

Moreover, a concha lock offers antenna locations that are at least partly extended away from the head of the wearer. Because flesh contains water, it has a relatively high electrical permittivity and is substantially electrically conductive. These properties of the head and skin can dramatically affect the electric fields of electromagnetic waves, absorbing RF energy that would have otherwise been available for transmission or reception. Because segments of a concha lock can be designed to extend at least a few millimeters away from the ear, a concha lock antenna can reduce such attenuation.

FIGS. 5A and 5B show cross-sections through two examples of positioning elements. FIGS. 5A and 5B may, for example, be cross sections through two examples of the concha lock shown in FIGS. 4A and 4B. Alternatively, or additionally, FIGS. 5A and 5B may be cross sections through two examples of the posts shown in FIGS. 2 and 3.

In these examples, the positioning element 125 includes a polymer 510 that extends over at least part of an outer surface of the conductive wire 505 (or the conductive wires 505*a* and 505*b*). The polymer 510 may, for example, include a plastic or an elastomer. In some examples, the positioning element 125 may include another type of cover material, such as silicone rubber, that extends over at least part of an outer surface of the conductive wire(s).

According to some examples, the conductive wire(s) may be formed and then coated, dipped, injection overmolded, co-molded or otherwise covered with a cover material using known manufacturing processes. The covering can provide electrical insulation as well as the opportunity for pleasing design benefits such as color and texture. Along with the wire, the physical properties of the cover material can provide elasticity that helps the concha lock exert retention force on the housing 105, thereby retaining the housing 105 in the ear.

In some implementations, the cover material may have its electrical permittivity and/or magnetic permeability tuned by loading with powders. Here "loading" is synonymous with "filling," and means substituting some, usually small, fraction of the cover material for another material. For example, plastics are commonly loaded with glass fibers to increase their rigidity, or with carbon to increase their conductivity.

To increase the electrical permittivity of the positioning element 125, the cover material may, for example, be loaded with Barium Strontium Titanate powder, available from TPL, Inc., in Albuquerque, N. Mex., which has a relative permittivity of up to 15,000. To increase the magnetic permeability, the cover material could be loaded, for example, with ferrite materials available from PPT, Inc., in Valparaiso, Ind., some of which have a relative permeability up to 3,000.

Because a concha lock can be mechanically attached to or formed as part of the housing 105, antenna wires within the concha lock can be fed through the wall of the housing 105 and connected to a circuit. For example, the wires may be connected to a circuit through RF connectors such as the very miniature examples available from Murata, Hirose, and others. Alternately, connections may be made using custom metal springs. The springs may, for example, be either crimped or soldered to the wires and pressed on the circuit board, or may be soldered to the circuit board and pressed on the wires or metal pieces attached to the wires. Depending on the number and configuration of the connections, the antenna may be a monopole, dipole, or loop.

Figure 6:
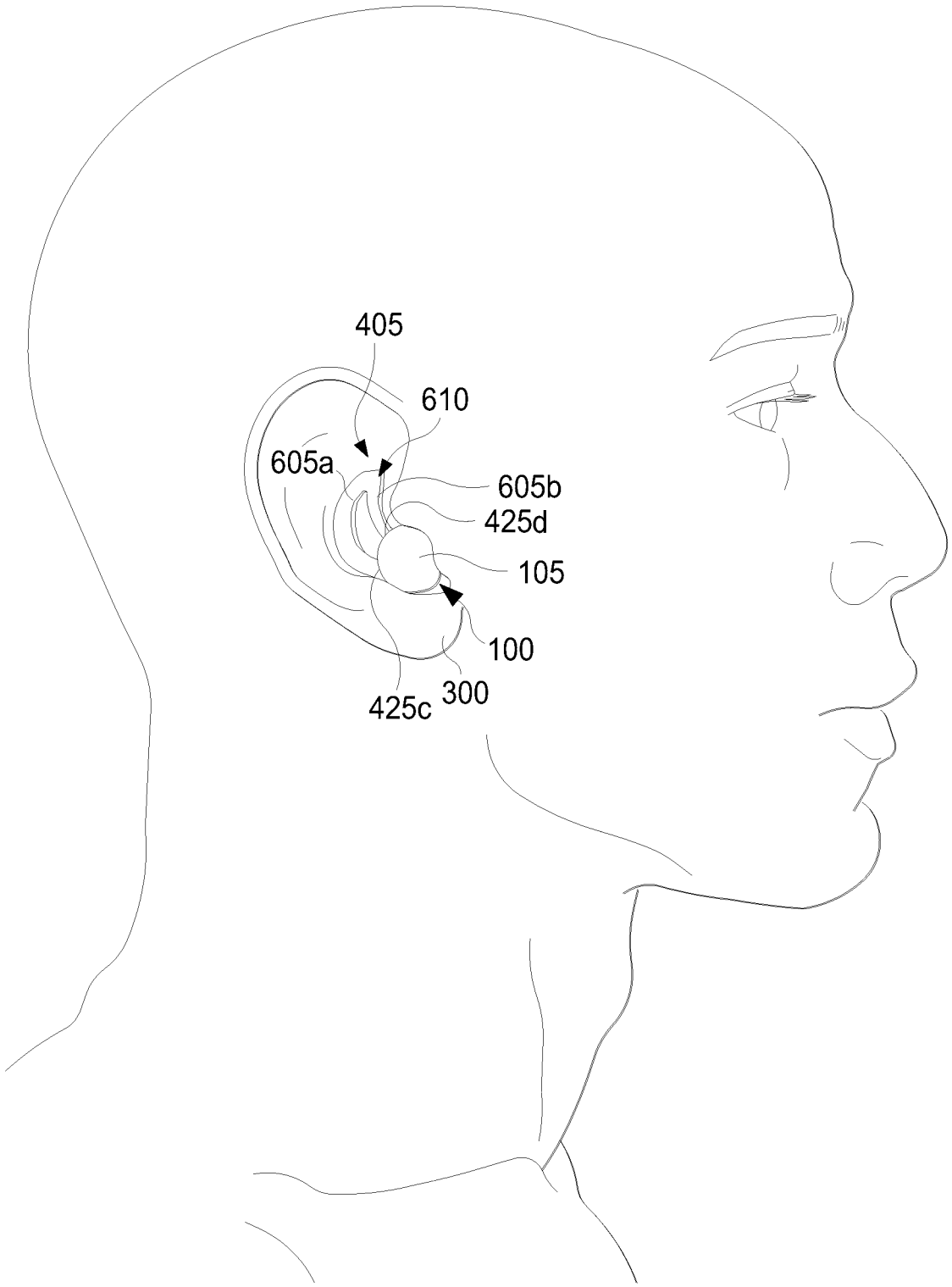
FIG. 6 shows another example of an in-ear device that includes a concha lock antenna.

FIG. 6 shows another example of an in-ear device that includes a concha lock antenna. In this example, the positioning element 125 includes a first segment 605*a* attached to a first housing location 425*c* and a second segment 605*b* attached to a second housing location 425*d*. According to this example, the first segment 605*a* and the second segment 605*b* are curved, with concave surfaces facing in substantially the same direction. Here, the first segment 605*a* and the second segment 605*b* are are joined to one another via an acute angle.

However, in other implementations the first segment 605*a* and the second segment 605*b* may be joined to one another via a larger angle or via one or more other segments. In other implementations, the first segment 605*a* and the second segment 605*b* may not be joined to one another. Instead, there may be a gap between the first segment 605*a* and the second segment 605*b*. In some examples, the first segment 605*a* and the second segment 605*b* may be joined, but either the first segment 605*a* or the second segment 605*b* may not be attached to the housing 105. According to some such examples, the concha lock may be compressed or otherwise shaped to accommodate a range of different ear sizes and ear shapes.

In the example shown in FIG. 6, the concha lock is configured to fit under the antihelix 405 and to exert a force that which helps to hold the housing 105 forward and down, behind the tragus and the antitragus.

Various modifications to the implementations described in this disclosure may be readily apparent to those having ordinary skill in the art. The general principles defined herein may be applied to other implementations without departing from the scope of this disclosure.

For example, some methods involve receiving radio frequency radiation via one or more wires of a concha lock that is attached to the housing of an ear device, such as a hearing aid or an ear bud. Some such methods may involve a control system of the ear device receiving radio frequency signals via the one or more wires of the concha lock. The one or more wires may be configured for communication with (e.g., electrically connected to) the control system. The control system may be configured for radio frequency communication. Some such methods may involve the control system causing radio frequency radiation to be transmitted by the one or more wires of the concha lock. Some such methods may involve controlling an ear device speaker according to received radio frequency radiation or charging an ear device battery via received radio frequency radiation.

Thus, the claims are not intended to be limited to the implementations shown herein, but are to be accorded the widest scope consistent with this disclosure, the principles and the novel features disclosed herein.

The invention claimed is:

1. An apparatus, comprising:

a housing adapted for at least partial insertion into an ear canal or a concha bowl of a human ear;

at least one speaker residing in or on the housing;

a control system residing in or on the housing, the control system configured for controlling the speaker and configured for radio frequency communication;

a positioning element extending from the housing, the positioning element comprising:

one or more wires;

a post; and a tip configured for at least one of transmitting or receiving radio frequency radiation; and wherein the one or more wires of the positioning element are configured for communication between the tip and the control system.

2. The apparatus of claim 1, the positioning element being configured to fit at least partially inside a concha of the human ear, the positioning element being further configured to retain the housing at least partially within the ear canal or the concha bowl.

3. The apparatus of claim 1, wherein the positioning element comprises a concha lock, the one or more wires forming an antenna built in the concha lock.

4. The apparatus of claim 3, wherein the antenna is a loop antenna.

5. The apparatus of claim 3, wherein the concha lock is configured to fit under at least a portion of an antihelix of the human ear.

6. The apparatus of claim 1, wherein the concha lock comprises a polymer that extends over at least part of an outer surface of the one or more wires.

7. The apparatus of claim 6, wherein the polymer comprises at least one of a plastic or an elastomer.

8. The apparatus of claim 6, wherein at least a portion of the polymer is loaded with a powder.

9. The apparatus of claim 8, wherein the powder increases at least one of an electrical permittivity or a magnetic permeability of the polymer.

10. The apparatus of claim 3, wherein the concha lock is circular, or substantially circular, in shape.

11. The apparatus of claim 3, wherein the concha lock forms a loop comprising a first segment attached to the housing at a first housing location and a second segment attached to the housing at a second housing location.

12. The apparatus of claim 1, wherein the apparatus comprises a hearing aid or an ear bud.

13. The apparatus of claim 1, wherein the tip configured for at least one of transmitting or receiving the radio frequency radiation comprises a chip antenna or a loop antenna.

14. The apparatus of claim 1, wherein the tip is configured to protrude from an integral notch of the human ear.

15. The apparatus of claim 1, wherein the one or more wires include a central wire and a coaxial shield.

16. The apparatus of claim 1, wherein the post has a post length associated with a desired insertion depth.

17. The apparatus of claim 1, wherein the tip includes a decoration including electrically conductive material.

* * * * *